US006676125B2

(12) United States Patent
Thünker et al.

(10) Patent No.: US 6,676,125 B2
(45) Date of Patent: Jan. 13, 2004

(54) ACTUATOR-GRIPPER CONTROL

(75) Inventors: Norbert Thünker, Hirschberg (DE); Jürgen Maass, Wiesloch (DE); Volker Müller, Eppingen (DE); Thomas Schaeffer, Mauer (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 20 days.

(21) Appl. No.: 10/011,875

(22) Filed: Nov. 5, 2001

(65) Prior Publication Data

US 2002/0063383 A1 May 30, 2002

(30) Foreign Application Priority Data

Nov. 3, 2000 (DE) ..... 100 54 452

(51) Int. Cl.[7] ..... B65H 5/12

(52) U.S. Cl. ..... 271/268; 271/267; 414/740; 294/104

(58) Field of Search ..... 271/263, 262, 271/264, 267, 268; 414/740; 294/104

(56) References Cited

U.S. PATENT DOCUMENTS

| | | | | |
|---|---|---|---|---|
| 3,987,917 A | * | 10/1976 | Husges et al. | 414/800 |
| 4,344,729 A | * | 8/1982 | Orsinger et al. | 414/226.02 |
| 4,531,726 A | * | 7/1985 | Bornstein | 271/263 |
| 4,634,107 A | * | 1/1987 | Vandersyde et al. | 270/56 |
| 4,697,246 A | * | 9/1987 | Zemke et al. | 702/128 |
| 4,728,097 A | * | 3/1988 | Vandersyde et al. | 271/268 |
| 5,333,547 A | | 8/1994 | Pfisterer et al. | |
| 5,749,572 A | | 5/1998 | Fricke et al. | |
| 5,816,771 A | * | 10/1998 | Stevens | 414/729 |
| 6,203,084 B1 | * | 3/2001 | Kruk et al. | 294/104 |

FOREIGN PATENT DOCUMENTS

| | | |
|---|---|---|
| DE | 1 100 043 | 2/1961 |
| DE | 2 113 750 | 10/1971 |
| DE | 2 302 519 | 8/1973 |
| DE | 42 00 406 A1 | 7/1993 |
| EP | 0 236 577 A1 | 9/1987 |
| EP | 0 775 576 B1 | 5/1997 |

* cited by examiner

*Primary Examiner*—Donald P. Walsh
*Assistant Examiner*—Kaitlin Joerger
(74) *Attorney, Agent, or Firm*—Laurence A. Greenberg; Werner H. Stemer; Ralph E. Locher

(57) ABSTRACT

A pre-gripper driving device for a pre-gripper cyclically driven oscillatingly and serving for transporting individual sheets in a sheet-processing machine, includes sheet grippers disposed at a free end of a rocking lever pivotable about a pivot pin fixed to a frame, the sheet grippers being movable relative to a gripper support about a gripper shaft aligned parallel to the pivot pin, for closing and opening the sheet grippers, and an activatable and regulatable drive for producing the movement of the grippers, the drive, on one hand, being connected to the sheet grippers and, on the other hand, being supported on one of the rocking lever and the frame; and a printing unit, a digital printing unit, a rotary printing machine and a multicolor rotary printing machine, respectively including the pre-gripper driving device.

13 Claims, 6 Drawing Sheets

ACTUATOR-GRIPPER CONTROL

BACKGROUND OF THE INVENTION

Field of the Invention

The invention relates to a device for actuating grippers in a machine for processing sheetlike material, such as a sheet-processing rotary printing machine, wherein sheets are transported by grippers.

The published German Patent Document DE 42 00 406 A1 is concerned with a gripping device in sheet-processing machines. The grippers for a sheet-like material are fastened on a gripper operating shaft. The grippers are opened and closed simultaneously via a cam control device. By employing the teachings provided in this published German patent document, individual grippers or groups of grippers on the circumference of a sheet-guiding cylinder are activated independently of one another. A control device which activates the grippers is provided for this purpose, the control device including at least one sensor, an opening and/or closing mechanism for the grippers and a computer. The control device actuates the opening and/or closing mechanisms at a prescribed machine position or setting. The sensors used in this heretofore known construction are angle-of-rotation sensors or paper-position sensors, in order to detect either the position of the cylinder or the position of the sheet-like material, and then to actuate the opening and closing mechanism.

The published European Patent Document EP 0 775 576 B1 is concerned with a gripper control device for a cyclically oscillatingly driven pre-gripper for transporting individual sheets in a sheet-fed printing machine. This published document discloses a gripper control device for a cyclically oscillatingly driven pre-gripper accommodated at a free end of a rocking lever pivotable about a pivot pin fixed to a frame, the pre-gripper having at least one sheet gripper. The sheet gripper is forcibly movable about a joint pin aligned parallel to the pivot pin, by cams for closing and opening purposes, as the sheets are received and transferred. One of the cams revolves with a single revolution and, in the course thereof, pivots the other cam, which is pivotably mounted on a stationary roller lever. The position of the cams determines the points in time at which the gripper closes and opens.

A switching mechanism is provided in order to fix the pivotable cam, this cam having a gripper-closing region and a gripper-opening region. The gripper-closing region is additionally provided with a gripper-opening region, the additionally arranged gripper-opening region having assigned thereto, for compensation purposes, an additional gripper-closing region on the single-revolution cam.

In order to produce closing or opening movements of sheet-gripping grippers, use has been made heretofore, in particular, of mechanical cam mechanisms, and occasionally also coupler mechanisms. These drives have the disadvantage that usually a fixed mechanical coupling is provided for the main machine drive, and that it is not possible to change the movement due to the kinematic dimensioning. This means that the movement cannot readily be adapted during operation to changed boundary conditions, e.g., a different printing-material thickness. In the case of double-sheet detection, mechanical barriers prevent the grippers from closing, so that the double-sheet formation cannot be gripped and conveyed into the machine. This improvement or solution, however, involves great mechanical outlay in order to realize the basic functions such as gripper control, paper-thickness adaptation and defective-sheet detection. The entire "pre-gripper" system is subjected to disruptive force action during the gripper actuation, and this solution also causes the machine to be subjected to a retroactive torque effect. The system used for closing the grippers during double-sheet detection requires long reaction times and takes up installation space in printing units. Furthermore, using the aforementioned improvements or solutions for producing the closing and opening movements of sheet-gripping grippers, movement can only be introduced at the ends of the gripper shaft.

SUMMARY OF THE INVENTION

In view of improvements or solutions heretofore known from the prior art, and of the technical problems which are presented, it is an object of the invention to provide a gripper control which requires only low mechanical outlay, performs the functions required of the gripper control and has as little effect as possible on the movement of a pre-gripper.

With the foregoing and other objects in view, there is provided, in accordance with a first aspect of the invention, a pre-gripper driving device for a pre-gripper cyclically driven oscillatingly and serving for transporting individual sheets in a sheet-processing machine, comprising sheet grippers disposed at a free end of a rocking lever pivotable about a pivot pin fixed to a frame, the sheet grippers being movable relative to a gripper support about a gripper shaft aligned parallel to the pivot pin, for closing and opening the sheet grippers, and an activatable and regulatable drive for producing the movement of the grippers, the drive, on one hand, being connected to the sheet grippers and, on the other hand, being supported on one of the rocking lever and the frame.

In accordance with another feature of the invention, the drive is actable centrally on the gripper shaft which serves for pivotably accommodating the sheet grippers.

In accordance with a further feature of the invention, the drive is introducible into both ends of the gripper shaft simultaneously.

In accordance with an added feature of the invention, the drive is realized as a linear drive with an extensible actuating element accommodated on the sheet grippers, respectively, at an articulation point thereon.

In accordance with an additional feature of the invention, the drive is realized as a rotary drive, serving for acting at least indirectly on the gripper shaft.

In accordance with yet another feature of the invention, the drive is realized as an actuating motor.

In accordance with yet a further feature of the invention, the actuating motor is operatively engageable with the gripper shaft via a rack and pinion.

In accordance with yet an added feature of the invention, the drive is constructed as a piezoelectric actuator.

In accordance with yet an additional feature of the invention, the drive is constructed as a piston/cylinder unit subjectible to a pressure medium.

In accordance with still another feature of the invention, the drive is a linear drive having a line of action running parallel to a direction of movement of a coupling link-mounted point of articulation of the linear drive on the pre-gripper lever.

In accordance with still a further feature of the invention, in closed condition of the sheet gripper, the point of articulation is located at least approximately on a connecting line between the gripper shaft and a point of rotation of the pre-gripper lever.

In accordance with still a further feature of the invention, in closed condition of the sheet gripper, the point of articulation is located between the gripper shaft and the pivot pin of the pre-gripper lever.

In accordance with still an added feature of the invention, a point of articulation of the drive coincides, on the frame, with the pivot point of the pre-gripper lever.

In accordance with still an additional feature of the invention, a point of articulation of the drive is disposed on the frame, and an actuating lever of the drive has a joint.

In accordance with a second aspect of the invention, there is provided a printing unit having a pre-gripper driving device for a pre-gripper cyclically driven oscillatingly and serving for transporting individual sheets in a sheet-processing machine, comprising sheet grippers disposed at a free end of a rocking lever pivotable about a pivot pin fixed to a frame, the sheet grippers being movable relative to a gripper support about a gripper shaft aligned parallel to the pivot pin, for closing and opening the sheet grippers, and an activatable and regulatable drive for producing the movement of the grippers, the drive, on one hand, being connected to the sheet grippers and, on the other hand, being supported on one of the rocking lever and the frame.

In accordance with a third aspect of the invention, there is provided a digital printing unit having a pre-gripper driving device for a pre-gripper cyclically driven oscillatingly and serving for transporting individual sheets in a sheet-processing machine, comprising sheet grippers disposed at a free end of a rocking lever pivotable about a pivot pin fixed to a frame, the sheet grippers being movable relative to a gripper support about a gripper shaft aligned parallel to the pivot pin, for closing and opening the sheet grippers, and an activatable and regulatable drive for producing the movement of the grippers, the drive, on one hand, being connected to the sheet grippers and, on the other hand, being supported on one of the rocking lever and the frame.

In accordance with a fourth aspect of the invention, there is provided a rotary printing machine having a pre-gripper driving device for a pre-gripper cyclically driven oscillatingly and serving for transporting individual sheets in a sheet-processing machine, comprising sheet grippers disposed at a free end of a rocking lever pivotable about a pivot pin fixed to a frame, the sheet grippers being movable relative to a gripper support about a gripper shaft aligned parallel to the pivot pin, for closing and opening the sheet grippers, and an activatable and regulatable drive for producing the movement of the grippers, the drive, on one hand, being connected to the sheet grippers and, on the other hand, being supported on one of the rocking lever and the frame.

In accordance with a concomitant aspect of the invention, there is provided a multicolor rotary printing machine having a pre-gripper driving device for a pre-gripper cyclically driven oscillatingly and serving for transporting individual sheets in a sheet-processing machine, comprising sheet grippers disposed at a free end of a rocking lever pivotable about a pivot pin fixed to a frame, the sheet grippers being movable relative to a gripper support about a gripper shaft aligned parallel to the pivot pin, for closing and opening the sheet grippers, and an activatable and regulatable drive for producing the movement of the grippers, the drive, on one hand, being connected to the sheet grippers and, on the other hand, being supported on one of the rocking lever and the frame.

An advantages which can be achieved by the construction proposed in accordance with the invention is, in particular, that the pre-gripper gripper control is now isolated mechanically from the main drive. In combination with a freely programmable control, which is thus independent of the main drive, flexible movement control of the grippers or gripper bars is possible by a dedicated regulatable drive, the movement control allowing, in a relatively straightforward manner, adaptation of the gripper movement to different types of operation, printing-material properties such as, for example, the printing-material thickness, and to different printing speeds. It is possible to dispense with additional, high-outlay adjustment devices and accessories.

In an advantageous possible realization of the concept upon which the invention is based, it is possible to use jointly or separately acting regulatable drives, whether they are linear drives or rotary drives, in any desired number or arrangement. It is thus possible, for example, for the drives for the sheet grippers, which are mounted on the gripper shaft, to be provided centrally on the gripper shaft or at the two ends thereof, with the result that alternatives are possible for effecting torque introduction into the gripper shaft. Depending upon the admissible torsional moment, it is also possible for the drive for actuating the gripper shaft to be introduced into both ends of the gripper shaft simultaneously.

It is possible for the drives to be constructed either as linear drives with an extensible actuating element which is accommodated on the sheet gripper directly at a point of articulation, or as a rotary drive acting directly or indirectly on the gripper shaft which accommodates the sheet grippers.

The rotary drives are configurable, for example, as actuating motors, whether they are electric motors or other drives which produce a rotary movement, while the linear drives are configurable, for example, as actuating cylinders, whether they are activated pneumatically, hydraulically or electromechanically. The movement of the drive may be transmitted indirectly by racks and pinions. It is also possible to provide piezoelectric actuators, which have a particularly quick response behavior and can convert extremely small actuating movements within extremely short periods of time. In order to improve the response behavior or to realize different actuating distances, it is possible for intermediate gear mechanisms to be accommodated between the individual enumerated drives which are possible. It is possible for the intermediate gear mechanisms, on the one hand, to be provided for adaptation to the given installation space, and they can be used for power-boosting purposes and for reducing the forces of inertia; on the other hand, self-locking may be produced by providing an intermediate gear mechanism.

The actuators for the gripper shaft, which serve as linear drives or rotary drives, may be supported either on a movable component or on a component which is fixed in relation to the machine frame. Instead of piezoelectric actuators, it is also possible to use magnetostrictive actuators in order to effect the gripper-opening and/or gripper-closing movement once the leading edge of the printing material has been gripped.

According to an advantageous different embodiment of the pre-gripper gripper drive proposed according to the invention, it is possible, using a linear drive for gripper control, for the line of action of the linear drive to run parallel to the movement direction of the coupling-like mounted point of articulation of the linear drive on the pre-gripper. In the closed state of the gripper, the point of articulation is located at least approximately on a connecting line between the gripper shaft and a point of rotation of the pre-gripper lever; furthermore, it is also possible, in the closed state of the gripper, for the point of articulation to be arranged between the gripper shaft and the pivot point of the pre-gripper lever.

With such an arrangement of the points of articulation, the linear drive, during the closing movement of the sheet grippers, assists the immediately following pivoting movement of the pre-gripper for accelerating the sheet to printing speed. As the sheet grippers are opened, the movement of the pre-gripper gripper lever can be utilized in order to accelerate the opening operation of the sheet gripper to a great extent because the movements of the linear drive and the pre-gripper lever are advantageously superposed, i.e., it is possible to utilize the advantageous relative movements for opening the sheet gripper quickly. By this arrangement, the masses which are to be moved on the pre-gripper are relatively small because it is virtually only the push rod of the linear drive, for example, formed as a piston rod, in the case of pneumatically activatable actuators, which moves along with the movement of the pre-gripper gripper lever about the pivot pin thereof. A further advantage which can be achieved by this configuration is that the linear drive is subjected only to low forces of inertia because only a relatively small, and thus slow, pivoting movement is executed. In addition, it is possible for an actuator subassembly to be accommodated in the stationary framework, which is mounted, however, for rotation. The transverse accelerations which are established are thus low, which additionally has a positive effect upon the service life of the sliding joints which are used.

The improvement proposed according to the invention for driving individual grippers or groups of grippers in the region of the pre-gripper can be used on sheet-processing machines, whether they are multicolor rotary printing machines for offset printing or digitally operating sheet-printing machines, wherein the stationary printing material is accelerated to the machine speed.

Other features which are considered as characteristic for the invention are set forth in the appended claims.

Although the invention is illustrated and described herein as embodied in an actuator-gripper control, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
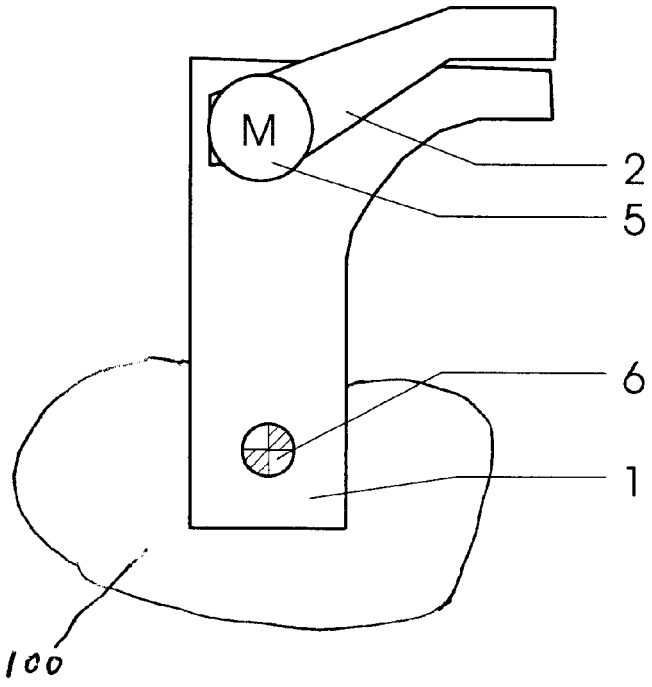
FIG. 1 is a diagrammatic side elevational view of a sheet gripper drivable by a rotary drive mounted on a pre-gripper.

Referring now to the drawings and, first, particularly to FIG. 1 thereof, there is show therein a greatly simplified illustration of a gripper actuatable by a rotary drive on a pre-gripper.

A rotary drive 5 is mounted on a pre-gripper lever 1, which is accommodated so as to be pivotabe about a frame point 6 configured as a pivot pin 6 fixed to a frame 100. This rotary drive 5, which may be in the form, for example, of an electric motor, a piezoelectric actuator or a magnetostrictive actuator, acts upon a gripper shaft 3 (note FIG. 2, for example), which is concealed by the drive 5 and on which sheet grippers 2 are accommodated in a distribution extending over the width of the pre-gripper. Via one or more rotary drives, the gripper shaft 3, whereon the individual sheet grippers 2 are accommodated, can drive each individual gripper or groups of grippers simultaneously. In the configuration according to FIG. 1, the rotary drive 5 is accommodated on a moving component 1, i.e., the pre-gripper lever.

Figure 2:
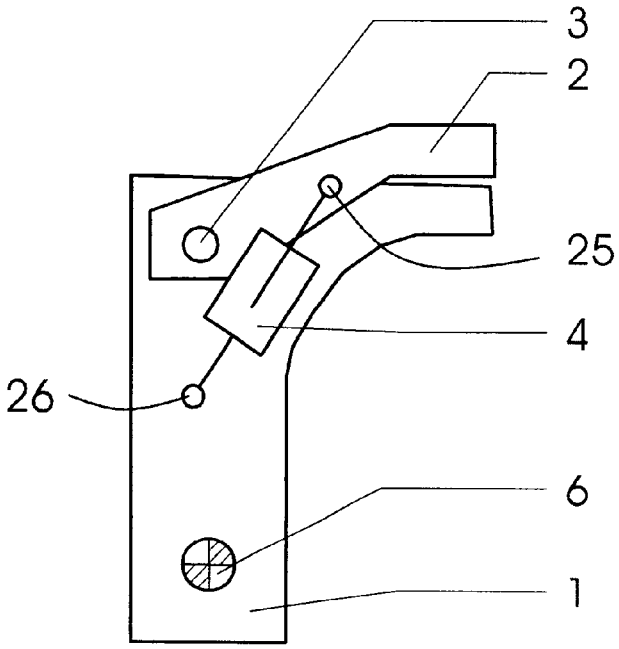
FIG. 2 is a view like that of FIG. 1 of a gripper disposed on a pre-gripper lever and actuatable by a linear drive.

FIG. 2 shows a sheet gripper located on a pre-gripper and actuatable via a linear drive.

The pre-gripper lever 1, which is represented diagrammatically in FIG. 2, is shown greatly reduced in scale relative to the sheet gripper 2, which is pivotable about the gripper shaft 3. An abutment of a linear drive 4 is accommodated at an articulation point 26 on the pre-gripper lever 1, an extendable actuating rod of the linear drive 4 being accommodated at an articulation point 25 of the sheet grippers 2, which are movable about the gripper shaft 3. The linear drive 4 may be a cylinder that is subjectible to the action of a pressure medium, for example, a pneumatic or a hydraulic cylinder. In the exemplary embodiment according to FIG. 2, the drive 4 on the pre-gripper lever 1 is configured as a cylinder.

Figure 3:
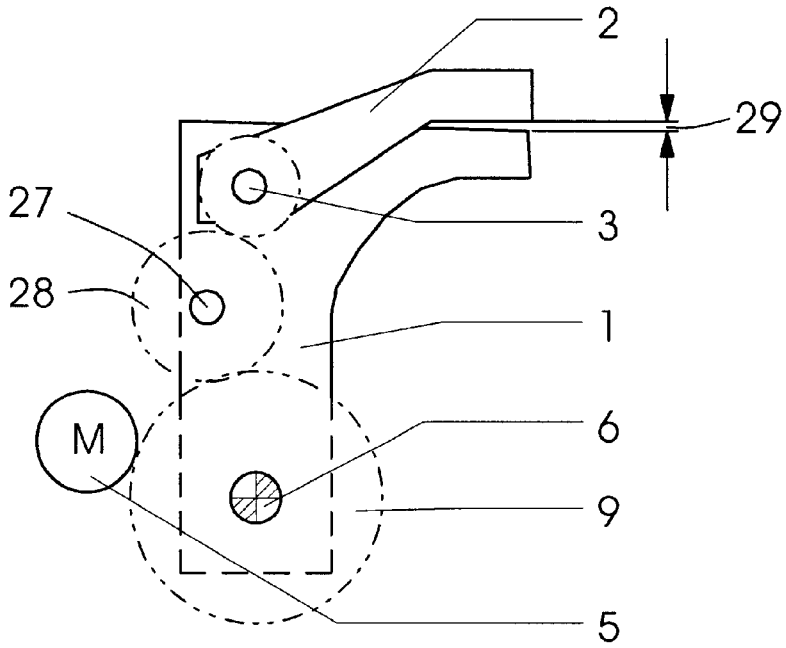
FIGS. 3 and 4 are views similar to those of FIGS. 1 and 2 showing drives for pre-gripper units, which are fixedly mounted on frames.
Figure 4:
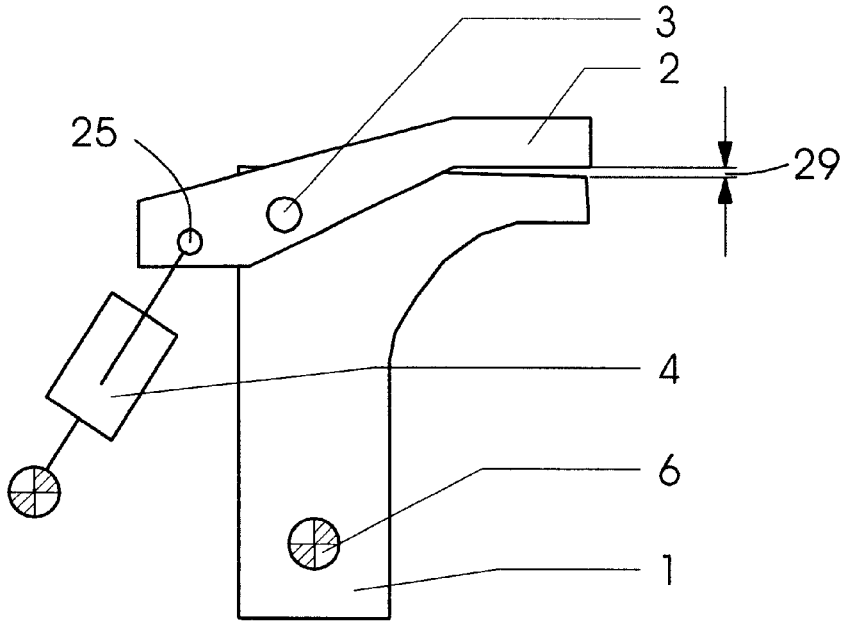

FIGS. 3 and 4 show drives for pre-gripper systems with frame-mounted drives.

The configuration according to FIG. 3 shows a rotary drive 5 which may be fastened to a side wall of a printing unit. The output of the rotary drive 5 acts upon a gearwheel 9, which, with the interposition of an intermediate wheel 27, accommodated on a stub shaft 28 on the pre-gripper lever 1, actuates the gripper shaft 3. The sheet grippers 2 are accommodated, once again, on the gripper shaft 3; in the configuration according to FIG. 3, a gripper gap 29, i.e., a spacing is defined between the underside of the sheet grippers 2 and the top side of the gripper support formed by the pre-gripper lever 1. During the closing movement of the sheet gripper 2, i.e., the movement of the sheet gripper 2 relative to the support formed by the pre-gripper lever 1, a sheet introduced into the gripper gap 29 is gripped at the leading edge thereof and accelerated to machine speed.

FIG. 4 shows a pre-gripper lever 1 whereon the sheet gripper 2 is accommodated so as to be pivotable about a gripper shaft 3. In this exemplary embodiment, the linear drive 4, in the form of an actuating cylinder, which is subjectible to the action of a pressure medium (hydraulically or pneumatically), is mounted frame-fixedly on the side wall of a printing unit of a rotary printing machine. The pre-gripper lever 1 is mounted so as to be rotatable about the pivot pin 6 thereof, while the linear drive 4 is accommodated at a different mounting point on the side wall. The actuating rod, which is extensible from the linear drive is accommodated at the point of articulation 25 on the sheet gripper 2 and causes the latter to move about the gripper shaft 3. The movement of the respective sheet gripper 2 can take place either individually for each sheet gripper or for groups of individual sheet grippers 2 on the pre-gripper lever 1.

Figure 5:
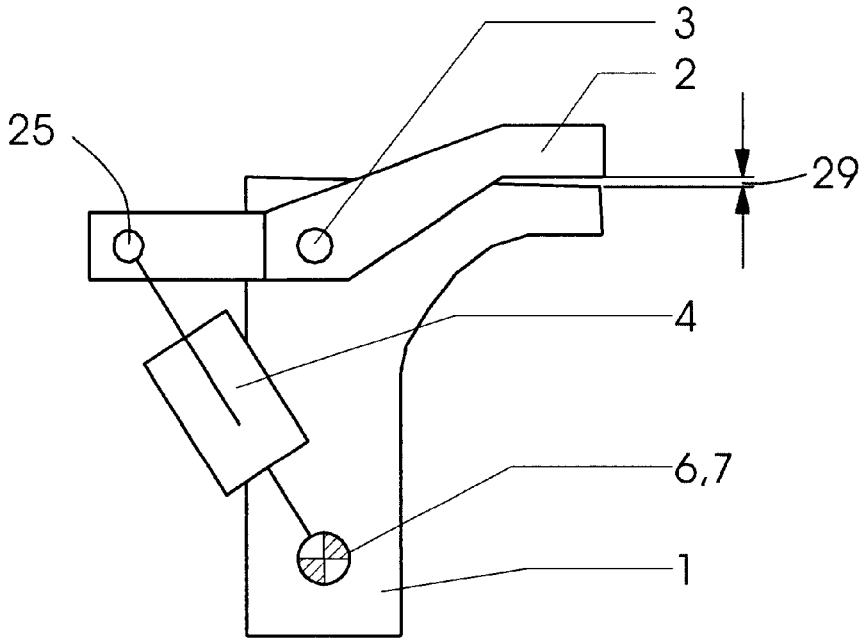
FIG. 5 is a view like those of the preceding figures showing a mounting support of the gripper drive, the mounting point of which coincides with a pivot point of the pre-gripper.

FIG. 5 shows a mounting support for the gripper drive, which coincides with the pivoting point of the pre-gripper lever.

In this configuration, the linear drive 4 is mounted simultaneously at the pivot point 6 of the pre-gripper lever 1, the extensible actuating rod of the linear drive 4 being connected at the point of articulation 25 to the sheet gripper 2, which can be pivoted about the gripper shaft 3.

It is possible for the linear drive 4, which is formed, for example, as a pneumatically or hydraulically activatable actuating cylinder, to be accommodated so as to be pivotable about the pivot pin 6, directly on the moving pre-gripper system; it is also possible for the abutment 7 of the linear drive 4 to be arranged just as easily in stationary side frames, allbeit coinciding with the pivot point of the pre-gripper lever about the pivot pin 6 thereof. This possible configuration offers the advantage that, upon activation of the linear drive 4, there is no need to take into account the movements resulting from the pivoting movements of the pre-gripper lever 1 and the movement of the sheet gripper 2 superposed thereon; furthermore, the masses which are to be moved are considerably smaller because, at least a main subassembly can be mounted rotatably in the side wall of a printing unit. A further advantage, which can be achieved by the embodiment according to FIG. 5, is that the supply lines for energy and information, i.e. the activating lines, may be of quite simple and straightforward configuration.

If only a single drive has been discussed heretofore herein, it is possible for undesired torsion of the gripper shaft 3 to be kept to a low level, or for the overall size of the drive 4 or 5, which is dependent upon the power requirement, to be reduced, by providing a plurality of drives connected in parallel. It is thus possible to provide, for example, instead of one large drive 4 or 5, respectively, at one end of the gripper shaft 3, two considerably smaller drives 4 and 5 at the two ends of the gripper shaft 3. Furthermore, it is also conceivable for the gripper shaft 3 to be driven from the middle thereof. In this construction based upon the inventive concept, the linear drive 4, in the form of an actuating cylinder executing an extension movement, is articulated rotatably on the pre-gripper lever 1, the extensible actuating rod of the linear drive 4 being articulated, for example, in the joint of a toggle lever 10. The toggle lever 10 is mounted at the point of articulation 26 on the pre-gripper lever 1 and is also fixed at the point of articulation 25 to the sheet gripper 2, which is pivotable about the gripper shaft 3. The pre-gripper lever 1, for its part, can be moved cyclically reciprocatingly about the pivot pin 6, which is accommodated in the machine frame.

Figure 6:
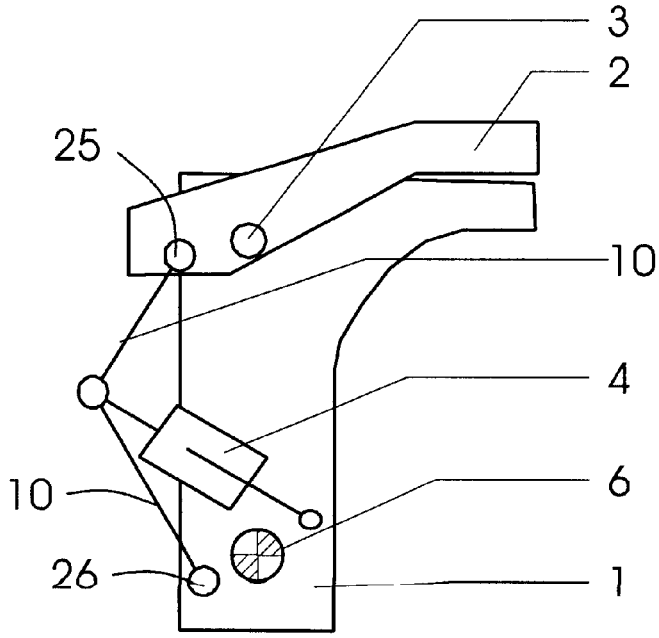
FIG. 6 is a view like those of the preceding figures showing toggle joints by which the pre-gripper gripper is actuated.

Via the toggle lever 10 on the pre-gripper system, which is used in FIG. 6, it is possible for the power of the linear drive 4 to be boosted to a considerable extent in an advantageous and straightforward manner.

Figure 7:
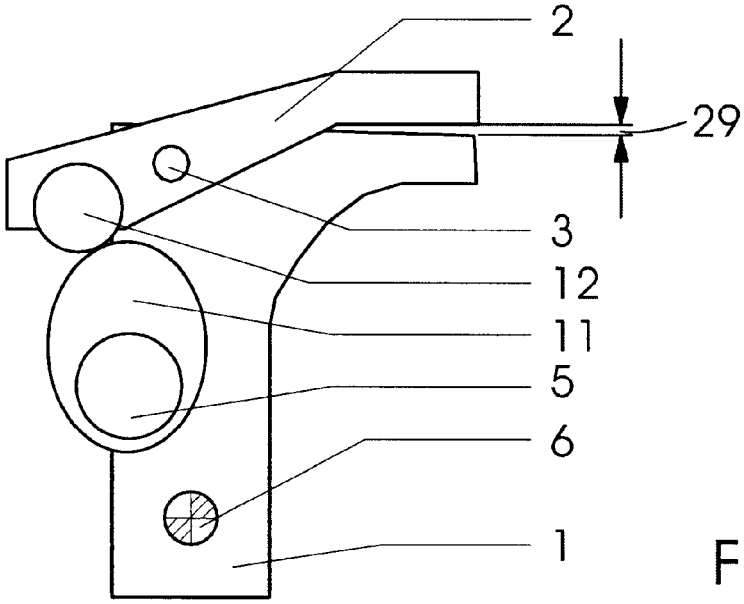
FIG. 7 is shows a view like those of the preceding figures showing a cam control of a pre-gripper system with a rotary drive.

FIG. 7 shows in greater detail a pre-gripper system driven via a cam mechanism or transmission.

Also, in the case of this embodiment of the invention, the pre-gripper lever 1 is movable about a frame-mounted pivot pin 6. Here, too, the sheet gripper 2 is movable about a gripper shaft 3; furthermore, play exists between the sheet gripper 2, which is movable about the gripper shaft 3 relative to the pre-gripper lever 1, and the gripper support formed by the pre-gripper lever 1, i.e., in other words, the gripper gap 29. In this embodiment of the invention, the control or the actuation, i.e., the operations of opening and closing the sheet gripper 2 about the gripper shaft 3 relative to the gripper support, may be produced by providing that a cam plate 11 be driven by a rotary drive 5, which produces a rotary movement. Depending upon the configuration of the outer contour of the cam plate 11, the cam roller 12 establishes the path of movement of the opening and closing movements, respectively, and the points in time, respectively, at which the sheet gripper 2 opens and closes. Via the cam control provided in this embodiment for the pre-gripper system, it is possible for the force flux and moment distribution to be predetermined extremely accurately.

Figure 8:
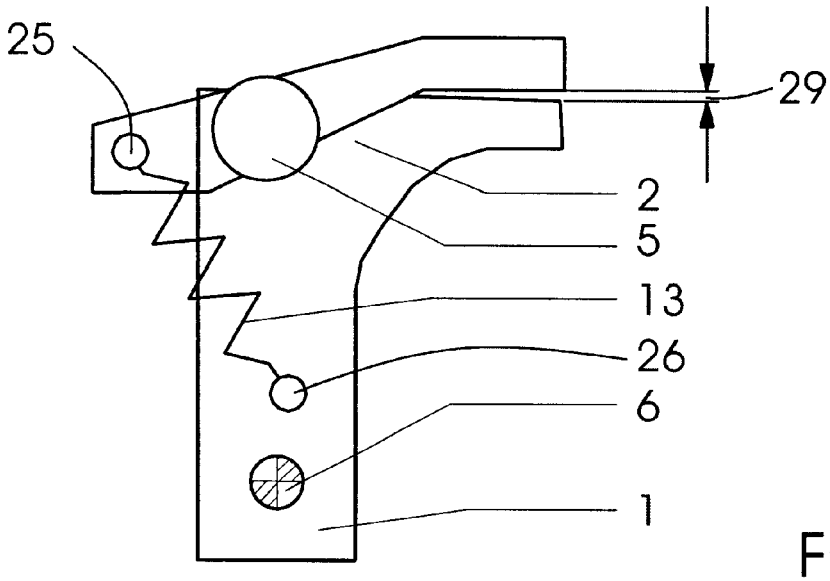
FIG. 8 is a view like those of the preceding figures showing the control of a gripper on the pre-gripper with a rotary drive and a restoring spring.
Figure 9:
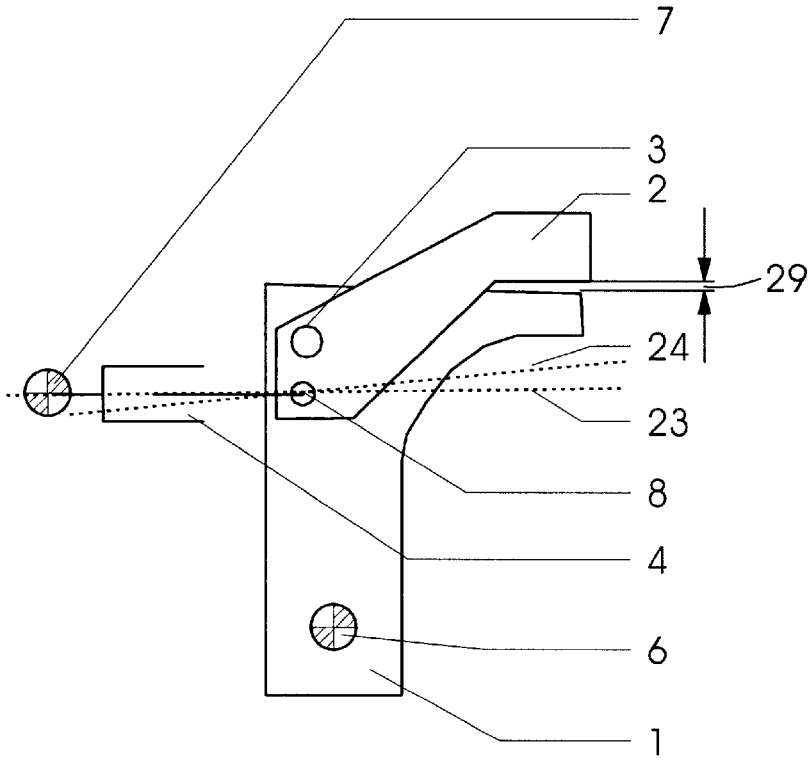
FIG. 9 is a view like those of the preceding figures showing a pre-gripper gripper control with advantageous movements of the components relative to one another.

FIG. 8 shows a rotary drive 5 which can be accommodated, for example, coaxially with the gripper shaft 3, and subjects the sheet gripper 2 to a rotary movement relative to the pre-gripper lever 1. In order to boost the closing and opening force of the sheet gripper 2 in relation to the support surface, and thus in relation to the geometry of the gripper gap 29 and the closing forces which can be produced there, the sheet gripper 2 is braceable by an energy storage device 13. The energy storage device 13, whether a tension spring or a compression spring, may be fastened to the pre-gripper lever 1 at the articulation point 26, while the other end of the energy storage device 13 is secured at the articulation point 25 of the sheet gripper 2. This additional energy storage makes it possible to produce, on the one hand, a desired prestressing in a desired central position and, on the other hand, automatic movement of the gripper in a given rest position in the event of a power failure. Instead of providing the compression spring 13, which is indicated only diagrammatically here, as the energy storage device, it is also possible to provide other energy storage devices. FIG. 9 shows in greater detail a pre-gripper gripper control with a drive arrangement, which utilizes advantageous movements of the components relative to one another.

The linear drive 4 that is used is accommodated at a rotational point 7 in the stationary machine frame of a printing unit of a rotary printing machine. As has already been explained hereinabove, the linear drive 4 may be configured as a pneumatic cylinder or as an hydraulic cylinder, and a configuration as a piezoelectric actuator or magnetostrictive actuator of the linear drive 4 is also conceivable. According to the configuration from FIG. 9, the piston rod, which serves as the displaceable element of the linear drive 4, is articulated at the articulation point 8 on the sheet gripper 2. The latter can be moved about the gripper shaft 3 in the same manner as has been explained hereinabove, and it is also true for this exemplary embodiment, that individual activation of a sheet gripper is possible, as is also groupwise activation of a plurality of sheet grippers 2 over the width of the pre-gripper lever 1.

It is also the case here that the gripper gap 29 is produced between the underside of the sheet gripper 2 and the support surface on the pre-gripper lever 1.

In the exemplary embodiment according to FIG. 9, the line of action 23 of the linear drive 4 runs parallel to the movement direction 24 of the coupling link-mounted articulation point 8 of the linear drive 4. In the closed state of the sheet gripper 2, the articulation point 8 may be located at least approximately on the connecting line between the center of the gripper shaft 3 and the rotational point 6 of the pre-gripper; furthermore, an alternative possibility is that, in the closed state of the sheet gripper 2, the articulation point 8 is located between the gripper shaft 3 and the rotational point 6 of the pre-gripper lever 1. The articulation point 7 of the linear drive 4 may advantageously be accommodated in the stationary machine frame, i.e., a side wall of the printing unit.

With such an arrangement of the articulation points 7 and 8, the linear drive 4, during the closing movement of the sheet gripper 2, assists the immediately following pivoting movement of the pre-gripper lever 1 about the pivot pin thereof. This advantageously achieves a situation wherein the drives assist one another. During the opening of the sheet gripper or grippers 2, the pivoting movement of the pre-gripper lever 1 about the pivot pin 6 thereof may be utilized in order to accelerate the opening operation to a great extent, because the movements of the linear drive 4 and of the pre-gripper lever 1 are advantageously superposed, with the result that favorable movements of the components relative to one another may be utilized. It is also advantageous, in this arrangement, that the masses, which are to be moved on the pre-gripper lever 1, are relatively small because it is essentially only the push rod of the linear drive 4, which moves along with the movement of the pre-gripper lever 1.

Further advantageous are the low forces of inertia which act on the linear drive 4 itself, because the latter only executes a relatively small, and thus slow, pivoting movement and, in addition, because an actuator subassembly, i.e. the linear drive 4, may be mounted rotatably in the stationary machine frame. Consequently, the transverse accelerating forces, which are to be borne by the components are also relatively low, which has, amongst others, a positive effect upon the service life of the sliding joints.

Figure 10:
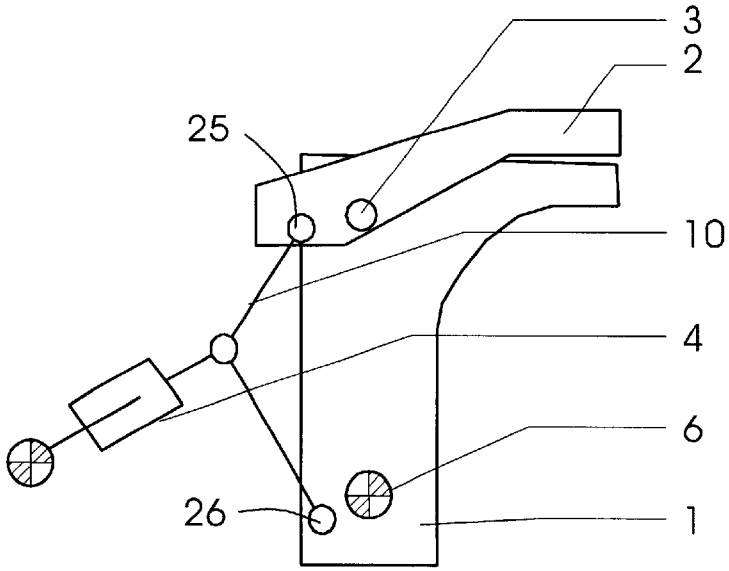
FIG. 10 is a view similar to those of the preceding figures showing a device for actuating the sheet gripper by a linear drive acting upon a toggle lever.

FIG. 10 shows in greater detail a possible actuation device of the sheet grippers accommodated on a pre-gripper system, wherein a toggle-lever system is coupled to a linear drive.

The pre-gripper lever 1, once again pivotable about the pivot pin 6 thereof, which is accommodated on both sides in the machine frame, comprises a gripper shaft 3 which, analogously to the aforedescribed embodiments, extends at least approximately parallel to the pre-gripper and whereon a plurality of sheet grippers 2 are accommodated in a pivotable manner. The actuating movements, i.e., the opening and the closing movements, respectively, of the sheet gripper 2, are provided by a frame-mounted linear drive 4, which acts upon the toggle joint of the toggle lever 10. The levers of the toggle lever 10 are mounted, on the one hand, at the articulation point 26 on the pre-gripper lever 1 and, on the other hand, at the articulation point 25 on the sheet gripper 2. This configuration ensures that the closing forces are considerably increased and maintained during the pivoting movement of the pre-gripper lever 1 about the pivot pin 6 thereof.

Figure 11:
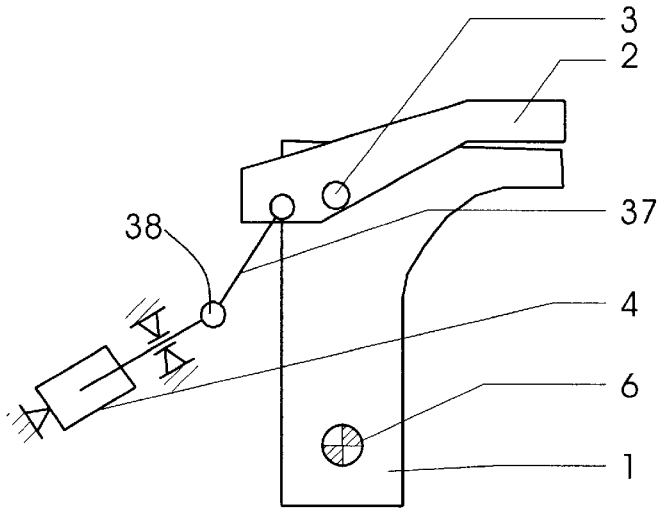
FIG. 11 is a view similar to that of FIG. 10 showing a device with a stationary linear drive and a joint lever, for actuating the sheet gripper.

The exemplary embodiment according to FIG. 11 provides for the linear drive 4 to be mounted in a stationary manner and for an actuating lever 37 to be provided with a joint 38. By this measure, virtually no transverse forces act upon the linear drive. In a favorable embodiment, the actuating lever 37 is guided between the linear drive 4 and the joint 38.

Figure 12:
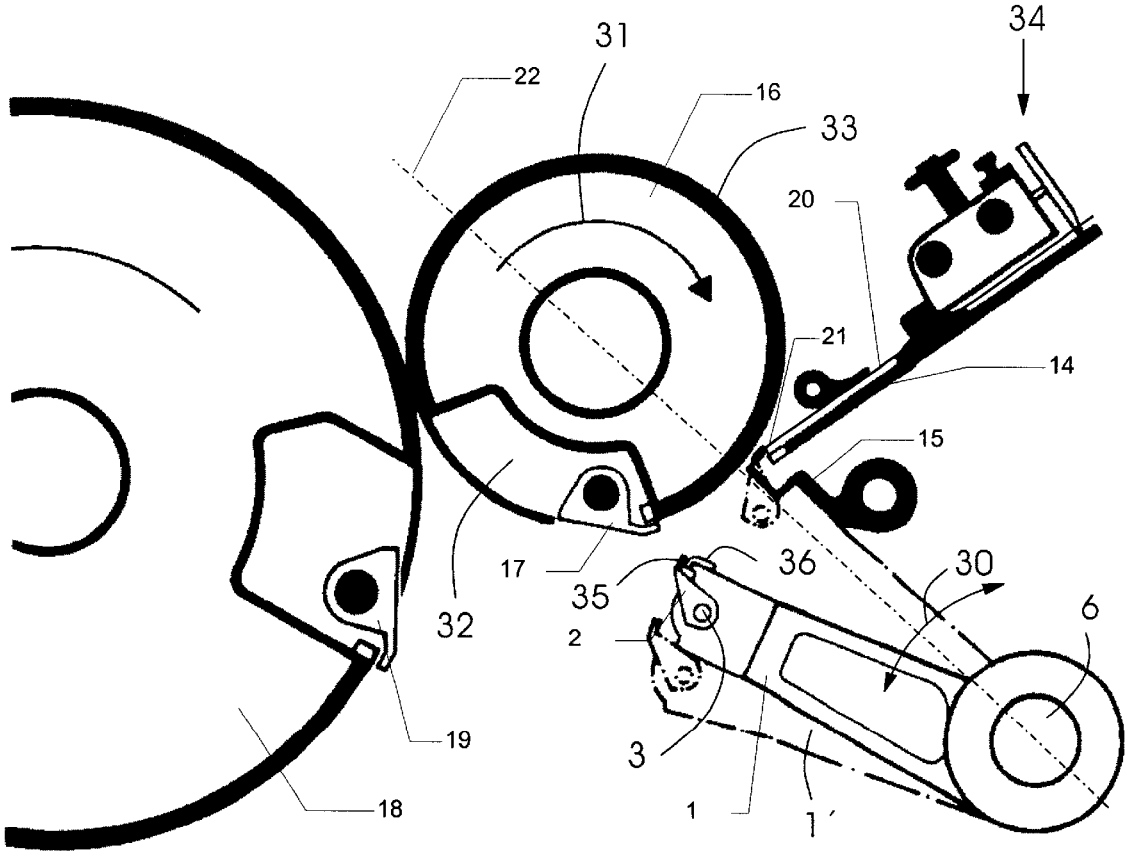
FIG. 12 is a diagrammatic side elevational view of a feeding table in the vicinity of a printing unit with side/pull guides, a pre-gripper and grippers for accepting or taking over sheets, the grippers being accelerated by the pre-gripper.

FIG. 12 shows the entire sheet-feeder region of a sheet-processing machine, whether a multi-color rotary machine for offset printing or a digital sheet-printing machine, in greater detail.

A sheet 20 which is to be printed abuts a front guide 15 on the feeding table 14 by the leading edge 21 of the sheet 20, aligned by a side or pull guide 34. The pre-gripper lever 1 is illustrated in the starting position thereof. The initially open sheet grippers 2 close and grip the leading edge 21 of the sheet-like material 20; the front guides 15 swing away downwardly; thereafter, the pre-gripper lever 1 pivots in accordance with the double-headed arrow 30 about the frame-mounted pivot pin 6 thereof. In this case, the sheet-like material 20 is accelerated to the printing-machine speed. Just before the transfer center line 22 has been reached, grippers 17 of a feed cylinder 16 grip the leading sheet edge 21, and the sheet grippers 2 of the pre-gripper lever 1 open a short time later. The sheet-like material 20 is then guided by a lateral surface 33 of the feed cylinder 16 and, a little later, transferred to grippers 19 of an impression cylinder 18. After the transfer of the sheet-like material 20, the pre-gripper lever 1 swings the sheet-like material 20 onto the lateral surface 33 of the feed cylinder 16 and, after reversing the movement direction 30 thereof, pivots back into the starting position thereof again.

In order to avoid collisions of the sheet grippers 2 with the feed cylinder 16 and the sheet-like material 20, the sheet grippers 2 move away downwardly during the returning pivoting operation, i.e. they close partially before they open again fully in order to accommodate the next sheet-like material 20.

If the sheet grippers 2, then, with the linear drives 4 and the rotary drives 5, respectively, are isolated mechanically from the main drive, then, in combination with a freely programmable control and regulatable drives, a flexible movement control of the sheet grippers 2 is possible, with the result that adaptation of the gripper movement to different types of operation, printing-material properties, for example, the printing-material thickness, and to different printing speeds is possible without high-cost conversion operations.

We claim:

1. A pre-gripper driving device for a pre-gripper cyclically driven oscillatingly for transporting individual sheets in a sheet-processing machine, the sheet-processing machine having a frame and a pivot pin fixed to the frame, the driving device comprising:

a pre-gripper lever having a free end, said pre-gripper lever being pivotable about the pivot pin;

sheet grippers disposed at said free end of said pre-gripper lever, said sheet grippers being movable about a gripper shaft parallel to the pivot pin, for closing and opening said sheet grippers relative to a gripper support; and an activatable and regulatable drive for producing the movement of said grippers, said drive, on one hand, being connected to said sheet grippers and, on the other hand, being supported on the frame via the pivot pin.

2. The driving device according to claim 1, wherein said drive is actable centrally on said gripper shaft which serves for pivotably accommodating said sheet grippers.

3. The driving device according to claim 1, wherein said drive is introducible into both ends of said gripper shaft simultaneously.

4. The driving device according to claim 1, wherein said drive is realized as a rotary drive, serving for acting at least indirectly on said gripper shaft.

5. The driving device according to claim 1, wherein said drive is realized as an actuating motor.

6. The driving device according to claim 5, wherein said actuating motor is operatively engageable with said gripper shaft via a rack and pinion.

7. The driving device according to claim 1, wherein said drive is constructed as a piezoelectric actuator.

8. The driving device according to claim 1, wherein said drive is constructed as a piston/cylinder unit subjectible to a pressure medium.

9. The driving device according to claim 1, wherein said drive is a linear drive having a line of action running parallel to a direction of movement of a coupling link-mounted point of articulation of said linear drive on said pre-gripper lever.

10. The driving device according to claim 9, wherein, in closed condition of said sheet gripper, said point of articulation is located at least approximately on a connecting line between said gripper shaft and a point of rotation of said pre-gripper lever.

11. The driving device according to claim 9, wherein, in closed condition of said sheet gripper, said point of articulation is located between said gripper shaft and said pivot pin of said pre-gripper lever.

12. The driving device according to claim 1, wherein said drive has a point of articulation coinciding with a pivot point of said pre-gripper lever.

13. The driving device according to claim 1, wherein a point of articulation of said drive is disposed on said frame, and an actuating lever of said drive has a joint.

* * * * *